US006570311B1

(12) United States Patent
Koh et al.

(10) Patent No.: US 6,570,311 B1
(45) Date of Patent: May 27, 2003

(54) SHADOW MASK IN FLAT CATHODE RAY TUBE

(75) Inventors: Nam Je Koh, Kyongsangbuk-do (KR); Jong Eon Choi, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 288 days.

(21) Appl. No.: 09/685,100

(22) Filed: Oct. 11, 2000

(30) Foreign Application Priority Data

Oct. 12, 1999 (KR) ..... 99/44072
Dec. 9, 1999 (KR) ..... 99/56248

(51) Int. Cl.[7] ..... H01J 29/80
(52) U.S. Cl. ..... 313/407; 313/402; 313/403
(58) Field of Search ..... 313/402, 404, 313/407, 408, 269, 403

(56) References Cited

U.S. PATENT DOCUMENTS 4,308,484 A * 12/1981 Carroll et al. ..... 313/402
4,562,377 A * 12/1985 Kamohara et al. ..... 313/402
5,049,778 A * 9/1991 Capek et al. ..... 313/407
5,363,011 A * 11/1994 Fendley ..... 313/408
5,910,702 A * 6/1999 Maehara ..... 313/407
6,111,347 A * 8/2000 Kwak ..... 313/402

FOREIGN PATENT DOCUMENTS

JP 11073889 A * 3/1999

* cited by examiner

*Primary Examiner*—Robert H. Kim
*Assistant Examiner*—Jurie Yun
(74) *Attorney, Agent, or Firm*—Fleshner & Kim, LLP

(57) ABSTRACT

Shadow mask in a flat cathode ray tube having a damping wire fastened across a no-hole region between adjacent lines of beam pass through holes formed on a vertical line in the shadow mask for damping vibration of the shadow mask, including means for limiting a position of the damping wire on the no-hole region of the shadow mask, thereby enhancing a damping effect to improve a picture quality, and permitting to simplify a fabrication process and cut down a production cost.

19 Claims, 8 Drawing Sheets

SHADOW MASK IN FLAT CATHODE RAY TUBE

BACKGROUND OF THE INVENTION

1. Field of the Invention

The present invention relates to a flat Braun tube, and more particularly, to a flat-tension shadow mask in a flat cathode ray tube.

2. Background of the Related Art

In general, the Braun tube(or a cathode ray tube) is employed in a TV or a display, and particularly, the flat Braun tube is used widely presently as the reduction of image distortion in the flat Braun tube improves a sense of vision, and the reduction of random reflection in the flat Braun tube reduces eye fatigue. A system and function of the related art flat Braun tube will be explained with reference to FIG. 1.

Referring to FIG. 1, the related art flat Braun tube is provided with a flat panel 1 having fluorescent material 3 coated on an inside, and a funnel 5 of a bulb form welded to a rear surface of the panel with Frit glass, to form an inner space at a high vacuum of $10^{-7}$ Torr. There is a rectangular rail 7 in the inner space of the panel 1 and the funnel 5 fitted on an inside surface of the panel 1, to which a shadow mask 9 having fine perforation of slits or holes 11 for passing electron beams is fitted with a tension given thereto in advance. And, there is an electron gun 13 built in a bottle neck formed neck part 6 in rear of the funnel 5 for emission of electron beams(thermal electrons) as red, green, and blue three color picture signals are provided thereto, and a deflection yoke 15 outside of the neck part 6 for forming electro-magnetic fields in vertical and horizontal directions for deflection of the electron beams.

When a picture signal is provided to the cathodes(not shown) in the electron gun 13 of flat Braun tube, electron beams of red, green, and blue three colors are emitted toward the fluorescent material 3 coated on an effective area inside of the panel 1. Most of the electron beams(approx. 85%) is blocked by bridges 14 of the shadow mask( or flat-tension mask) 9 as the electron beams pass through the shadow mask 9 on an electron beam path, while rest of the electron beams(approx. 15%) pass through the fine holes 11 in the shadow mask 9 and collide onto red, green, and blue fluorescent materials 3 to reproduce a color picture.

In the meantime, if an impact or interferential acoustic wave is provided to the Braun tube from outside, the shadow mask 9 will vibrates. In this instance, as shown in FIGS. 2 and 3, since a position of the fine hole 11 (hereafter called as "beam pass through hole") in the shadow mask 9 is varied with a vibration frequency, the electron beams can not pass through the beam pass through hole 11 regularly, but blocked by no-hole regions 12 and the bridges 14 periodically, to cause so called howling in which the picture shakes. In order to suppress this, a damping wire, a vibration attenuating means, is closely fitted to one side of the shadow mask 9. In this instance, the damping wire 8 is fitted across the no-hole region 12 between adjacent horizontal lines 11*a* and 11*b* of beam pass through holes in the shadow mask 9, by welding both ends to brackets 17 on the rail 7 under tension. And, there are reference holes 16 on both ends of a damping wire fitting path in the no-hole region 12 as reference points for aligning the damping wire 8 on an exact position of the no-hole region 12 by making the damping wire 8 to pass through the reference holes 16. However, keeping pace with the recent trend of requiring high definition TVs, an area for the damping wire 8 has been restricted as a pitch 'P' of the beam pass through holes 11 becomes gradually smaller, causing the damping wire 8 to move into an area of the beam pass through hole 11 even by a minute vibration of the shadow mask 9, to display a shadow on a screen. And, there has been difficulty in fabrication in that burr formed in welding the rail 7 to the shadow mask 9 impedes fastening the damping wire 8 at an exact position by welding through the burr.

There is another method for fastening a plurality of damping wires 8(3 in general) each with approx. 60 $\mu$m diameter under tension on the shadow mask 9 for controlling vibration of the shadow mask. In this instance, as the damping wire 8 has a diameter which is too small to weld itself on a rail assembly 7 directly, the welding is conducted under a condition a bracket 17 and a plate 21, both of which secure a welding area, are fitted on top and bottom of both ends of the damping wire 8. In a state each of the brackets 17 of a damping assembly formed thus is placed on a recessed step surface 7a of the rail assembly 7, the damping assembly is fixed to a top surface of the rail assembly 7.

However, in the related art damping wire, since the damping assembly has the bracket 17, the plate 21, and the damping wire 8 integrated as one unit, the damping assembly delays a Braun tube fabrication process and deteriorates an efficiency of the fabrication process as the damping assembly requires respective component fabrication processes, and a component integration process. Since the damping assembly is not closely fastened to the shadow mask effectively, the plurality of damping wires, in general 3, required for obtaining a damping effect of a desired level increases a number of components, that pushes up a production cost. And, the damping wire 8 coming into the area of the beam pass through hole 11 of the shadow mask 9 caused by shaky damping assembly deteriorates a picture quality. Since debris, produced when unnecessary edges of the shadow mask is cut off after the shadow mask is welded to the rail assembly and remained on a fastening surface of the damping wire 8, impedes close fastening of the damping wire 8 to the shadow mask 9, the related art damping wire can not provide a desired vibration attenuation effect required for the shadow mask.

SUMMARY OF THE INVENTION

Accordingly, the present invention is directed to a shadow mask in a flat cathode ray tube that substantially obviates one or more of the problems due to limitations and disadvantages of the related art.

An object of the present invention is to provide a shadow mask in a flat cathode ray tube, in which a damping wire can be fastened.at a more exact position and a fastening force between shadow mask and the damping wire are strengthened.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the shadow mask in a flat cathode ray tube having a damping wire located across a no-hole region between adjacent lines of beam pass through holes formed on a vertical line in the shadow mask for damping vibration of the shadow mask, includes means for limiting a position of the damping wire on the no-hole region of the shadow mask It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute apart of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

The shadow mask 9 of the present invention suggests to fasten at least one damping wire 8 on every no-hole region 12 between adjacent vertical lines 11*a* and 11*b* of beam pass through holes for suppressing vibration of the shadow mask 9. The present invention suggests to provide limiting means on the no-hole region 12 for preventing movement of the damping wire 8. The limiting means may have the following different embodiments.

Figure 1:
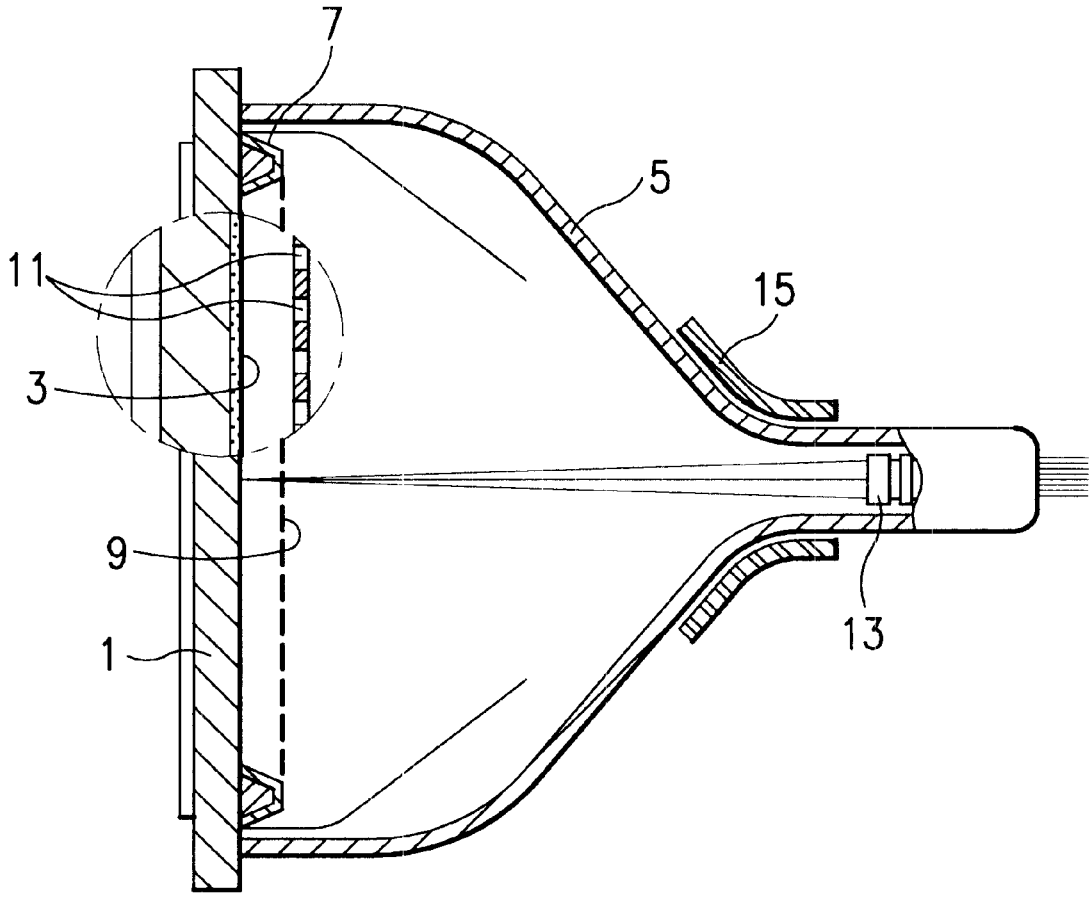
FIG. 1 Related Art
FIG. 1 illustrates a longitudinal section of a related art flat Braun tube.
Figure 2:
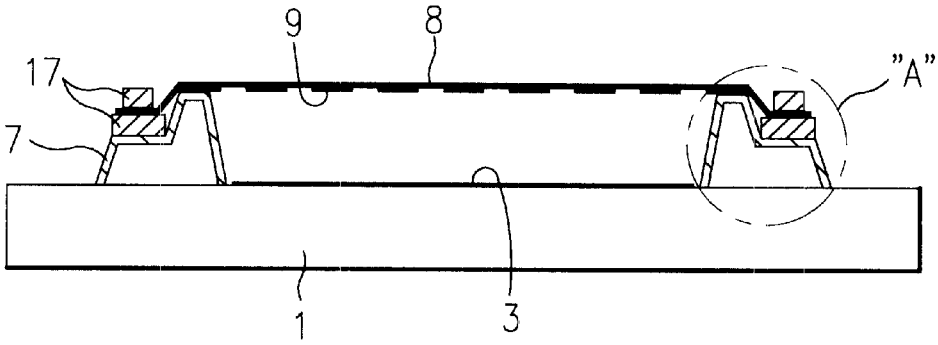
FIG. 2 Related Art
FIG. 2 illustrates a located damping wire.
Figure 3:
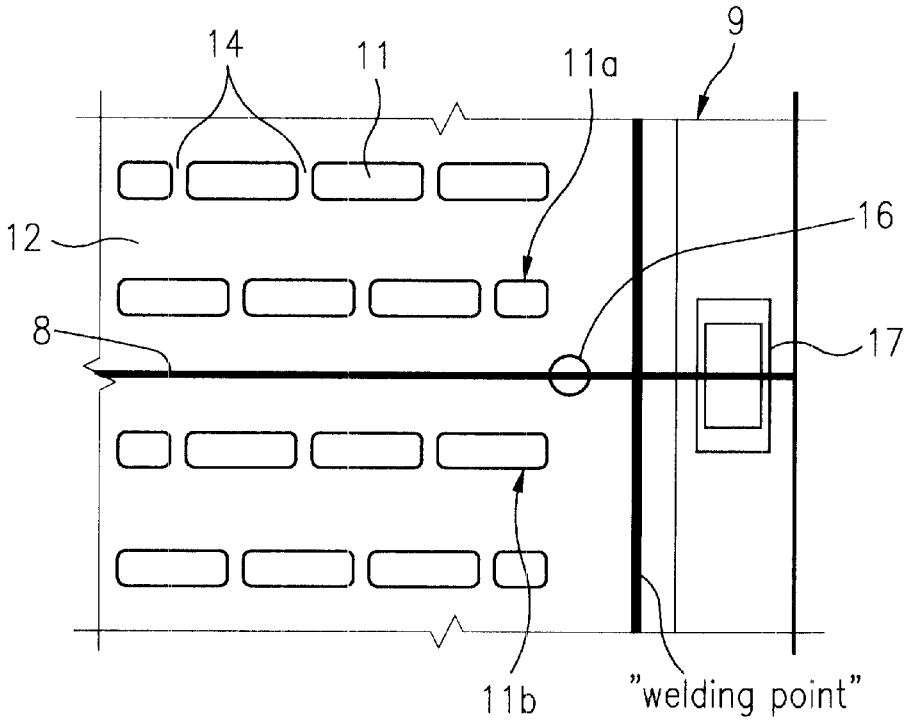
FIG. 3 Related Art
FIG. 3 illustrates a detail of key parts seen in "A" direction in FIG. 2.
Figure 4:
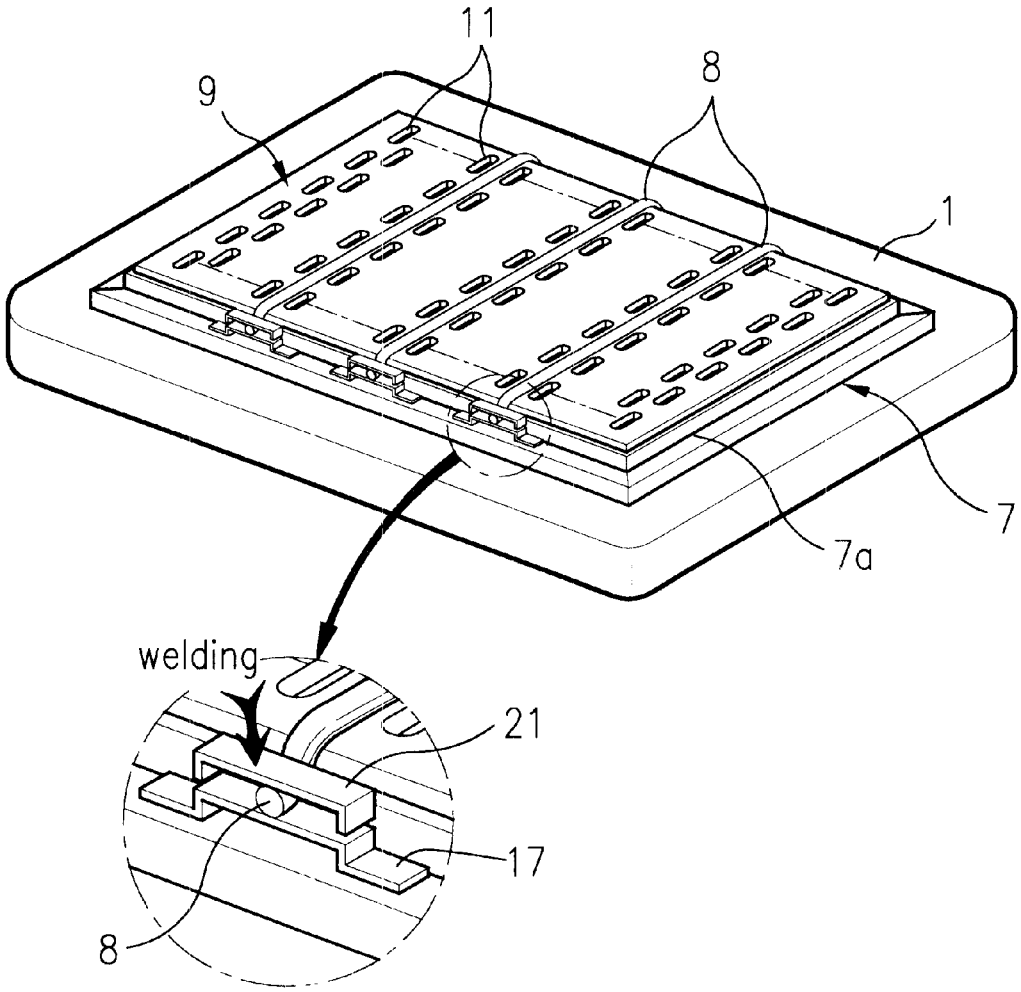
FIG. 4 Related Art
FIG. 4 illustrates a perspective view with a key part enlarged view of another example of related art damping wire located to a flat Braun tube.
Figure 5A:
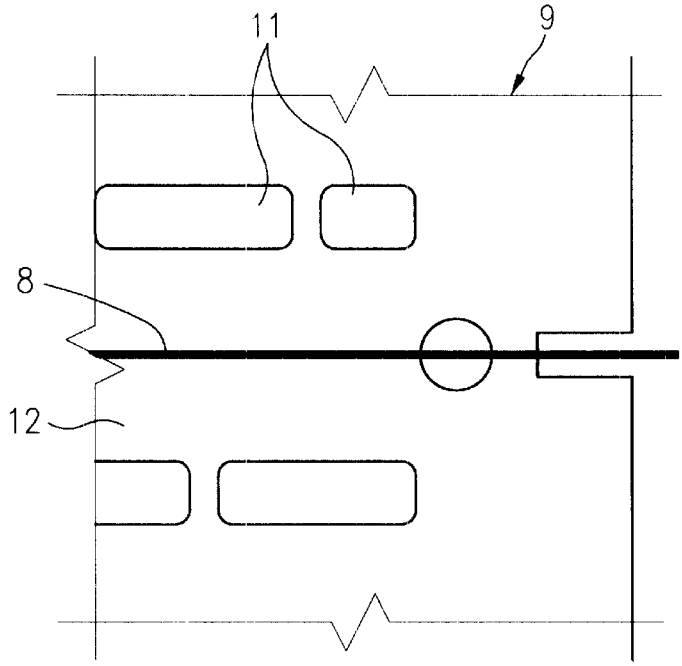
FIGS. 5A~5C illustrate a shadow mask in accordance with a first preferred embodiment of the present invention.
Figure 5B:
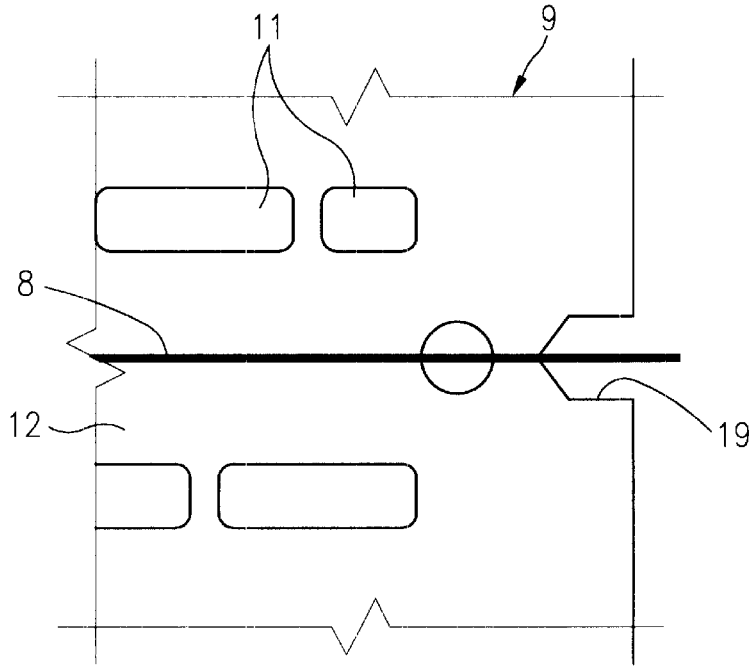
Figure 5C:
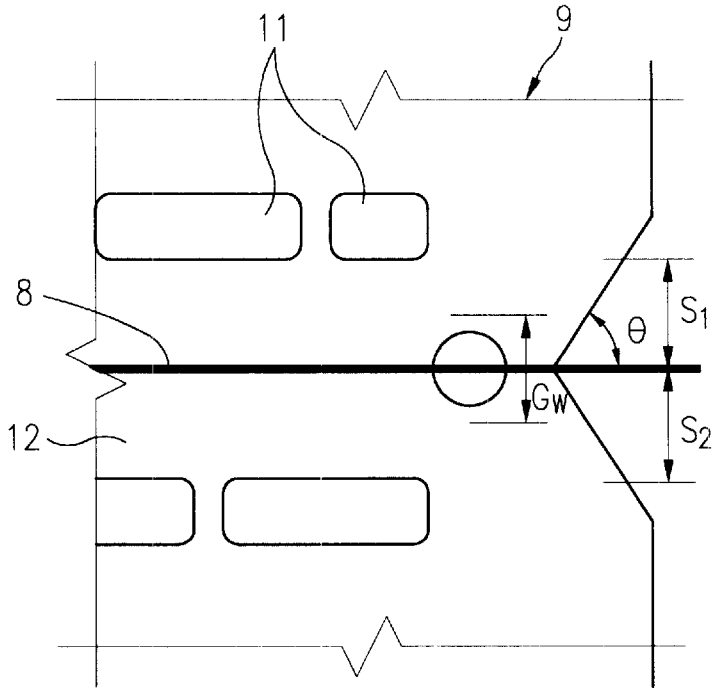

FIGS. 5A~5C illustrate a shadow mask in accordance with a first preferred embodiment of the present invention.

Referring to FIGS. 5A~5C, the first embodiment limiting means includes cut away parts 19 in a no-hole region 12 at both edges of the shadow mask, and a damping wire 8 for fastening the shadow mask 9 through the cut away parts 19. A step formed in each of the cut away parts 19 as much as a thickness of the shadow mask catches, and limits movements of the damping wire 8. The cut away part 19 may have a ⊏ form as shown in FIG. 5A, or triangular with the damping wire 8 crossing through an apex as shown in FIG. 5B or 5C. In the cases of the cut away parts of FIG. 5A or 5B, if a half angle θ of the apex angle 2θ is excessively smaller or greater than required, the fastening force of the damping wire 8 may be weakened. That is, if the apex angle of the cut away part 19 is to small to surround an outer circumference of the damping wire, ends of the damping wire 8 can not make a stable setting at the cut away part, such that the cut away part 19 fails to limit movement of the damping wire 8. And, if the apex angle of the cut away part 19 is too great, it is difficult to limit movements of the damping wire 8. Therefore, it is preferable that the apex angle is limited to a range of $10° \leqq \theta \leqq 60°$, and more preferably approx. 25°.

Figure 6A:
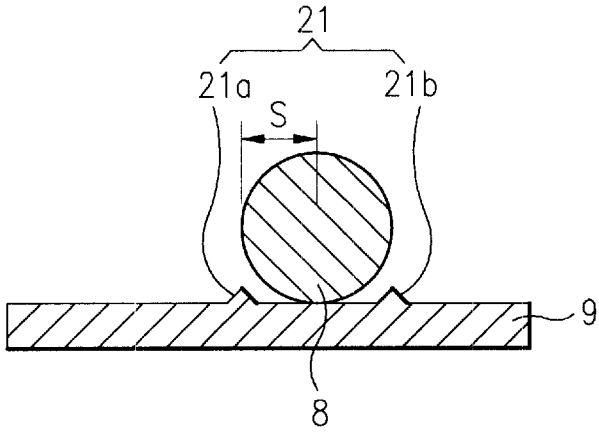
FIGS. 6A~6B illustrate a shadow mask in accordance with a second preferred embodiment-of the present invention.
Figure 6B:
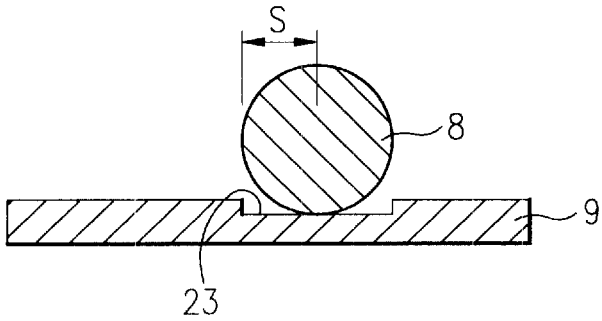

FIGS. 6A~6B illustrate a shadow mask in accordance with a second preferred embodiment of the present invention.

Figure 7A:
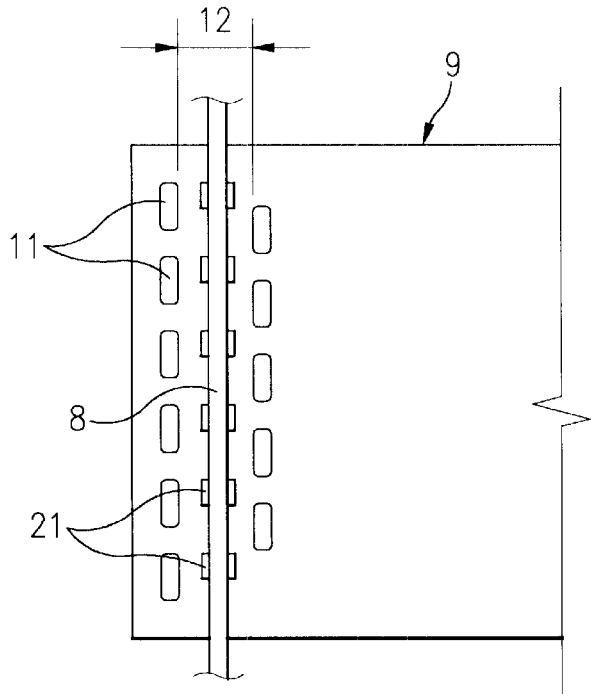
FIGS. 7A~7B illustrate a shadow-mask in accordance with a third preferred embodiment of the present invention.
Figure 7B:
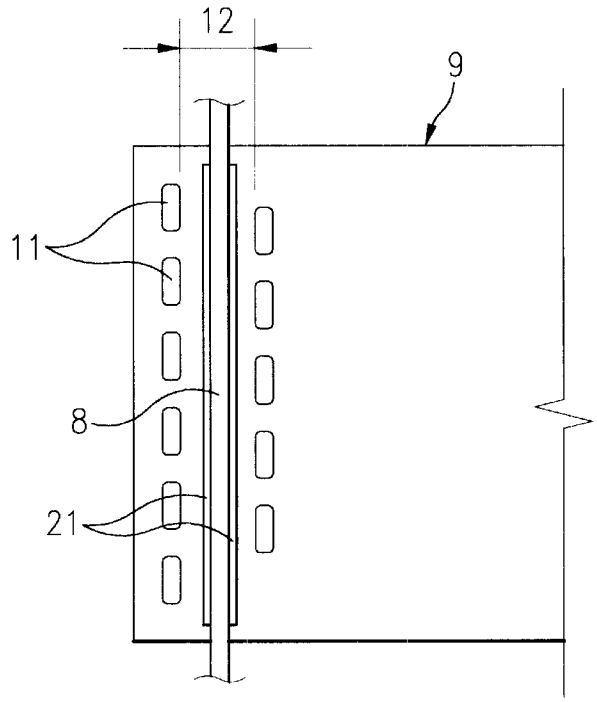

Referring to FIG. 6A or 6B, the second embodiment limiting means includes a damping wire 8 for fastening the shadow mask 9, and a groove, which may be formed by projections 21 from, or a recess 23 into a surface of the shadow mask, in a no-hole region 12 for setting the damping wire 8 therein. The projections 21 has one pair of projections 21*a* and 21*b*, between which the damping wire 8 is to run for limiting movement of the damping wire 8 from both sides of the damping wire 8. On the other hand, in formation of the recess 23, a thickness 't' of the shadow mask 9 should be in a range of 35~80 μm. If the thickness is below the range, the thickness is to thin to form an effective recess 23. Opposite to this, if the thickness is greater than the range, the shadow mask 9 has an enough strength to attenuate the vibration of the shadow mask 9 itself without help of the damping wire 8, it is preferable that the thicker shadow mask 9 is excluded since the thicker shadow mask 9 has problems of a material cost increase and additionally required tension. As the shadow mask will has an enough strength if the shadow mask is formed thicker, one fastening of the damping wire 8 around a center region of the shadow mask where the vibration is the greatest will be sufficient to obtain a desired level of attenuation. In this instance, for doubling the vibration attenuation effect, it is preferable that a diameter of the damping wire 8 is determined to be in a range of 60~μm, a diameter greater than the diameter of a related art damping wire with a tension approx. 600 gf. And, as shown in FIG. 7A, the projections 21 may be formed continuously, or in a form of dashed lines as shown in FIG. 7B, with triangular or rectangular sections along the no-hole region 12. However, in the case of the recess 23, the recess(groove) should be continuous along the no hole portion 12 because a dash form of recess can not permit full insertion of the damping wire 8 into the recess 23. The projections 21 together with the cut away portions 19, or the recess 23 together with the cut away portions 19 will strengthen the fastening force of the damping wire 8 against the shadow mask 9.

Figure 8:
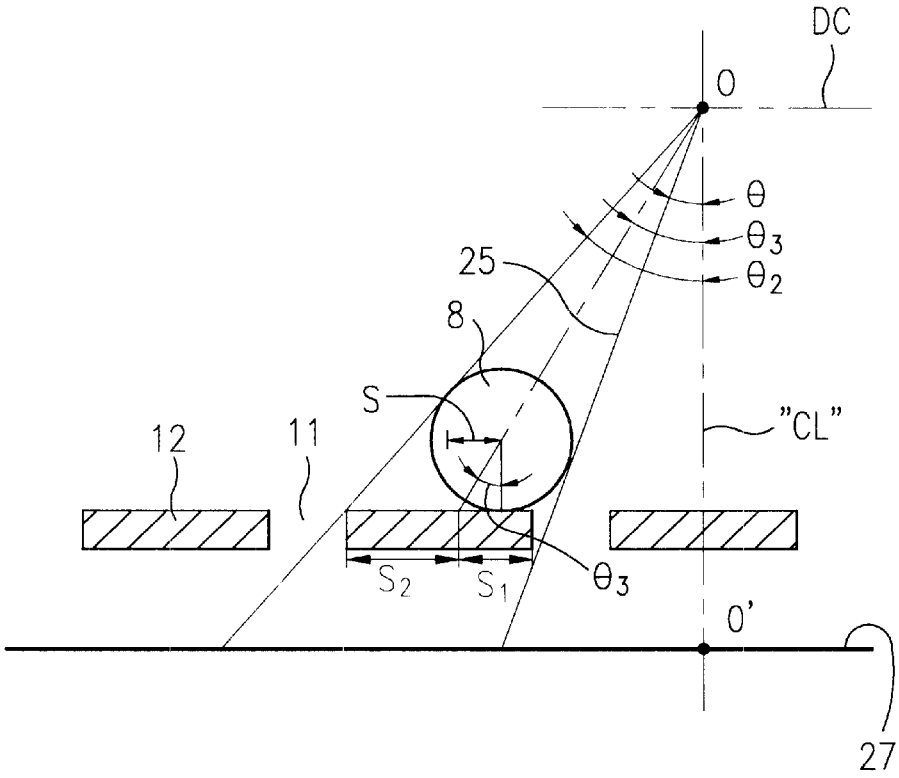
FIG. 8 explains a locating position of a damping wire.

FIG. 8 explains a locating position of a damping wire.

In the meantime, referring to FIG. 8, since the locating position of the damping wire 8 with respect to the no hole portion 12 should be vary with a deflection angle of the electron beams deflected from a deflection center '0', positions of the foregoing different limiting means should be selected according to the deflection angle. That is, an initial scanning of the electron beams starts from a center line 'CL' of the flat cathode ray tube, and the electron beams move to a periphery of the screen with an angle to the center line. According to this, the position of the damping wire 8 with respect to the no-hole region 12 should be varied with an angle of scanning of the electron beams when the damping wire 8 is not on the center line 'CL' but at a position away from the center line, otherwise the damping wire 8 blocks a portion of a path of the electron beams to form a shadow on the screen. A relation of such a scanning angle of the electron beam and the locating position of the.damping wire .8 will be explained with reference to FIG. 8. A distance from a screen center '0' to the deflection center '0' can be expressed as an equation (1) shown below.

$$D.C=Us/\tan\theta_3 \quad (1),$$

where, $\theta_3$ denotes a deflection angle of the electron beams 25 from the center line 'CL' of the tube, Us denotes a diagonal distance of the screen from the center line 'CL', and D.C denotes a distance from the screen 27 to the deflection center '0'.

As $\theta_3$ is also a center of the damping wire 8 fastened on the shadow mask to the deflection angle as shown in FIG. 8, a region the damping wire 8 can be fastened without forming a shadow is $\theta_2-\theta_1$. In this instance, as an incident angle of the electron beams to the shadow mask 9 are deflected from the center line CL the more as it goes the farther from the deflection center '0' toward a periphery of the screen, the position of the damping wire 8 with respect to the no-hole region 12 should be set up, taking the deflection angle and a diameter of the damping wire 8 into account. Since the center of damping wire should be on a line of the angle $\theta_3$, and, since the damping wire should be located away from a center of centers of adjacent shadow mask holes by "S" in a horizontal direction, it is the most effective that the damping wire is fastened such that a center of the damping wire is positioned with a position ratio of S2 and S1 if a radius of the damping wire is "0". Accordingly, if the damping wire has a particular radius to be $\theta_2-\theta_3=\theta_3-\theta_1$, an equation (2) below can be obtained.

$$\tan\theta_3=R/S \quad (2),$$

where, S denotes a horizontal distance between the center of the no-hole region and the center of the damping wire, R denotes a radius of the damping wire 8, and $\theta_3$ denotes an angle between the center line CL of the tube and the center line of the damping wire, from which an equation $S=R\times\tan\theta_3$ may be obtained, that permits to set up a position of the damping wire 8. Once the position of the damping wire 8 with respect to the no-hole region 12 is fixed, the position of the limiting means can be fixed, accordingly. For example, once the position of the damping wire 8 with respect to the no-hole region 12 is calculated, a desired fastening force can be obtained if the apex or a center line of the cut away part lies on a position the same with the center line of the damping wire 8. A lateral length of the cut away part is set up to be within a range from an effective surface to an outer circumference of the rail for avoiding interference to the effective surface of the fluorescent material.

And, by using the horizontal distance 'S' between the center of the no-hole region and the center of the damping wire, a position of the projections 21 or the recess 23 formed in the no-hole region the damping wire set thereon can be set as follows. Particularly, because the projections 21 shown in FIG. 6A, with the one pair of projections 21*a* and 21*b*, support the damping wire 8 as the damping wire 8 is laid on a region between the projections 21, such that the projections 21 support an outer circumference of the damping wire from both sides, a distance between one side of the projections 21 and the center of the damping wire is "S". Similar to this, in FIG. 6B, a horizontal distance between one side of the recess and the center of the damping wire is "S".

A formation range Gw of the projections or the recess on the no-hole region may be expressed as an equation (3) below, if a diameter of the damping wire is small.

$$Gw\leqq S_2-R+S_1-R \quad (3),$$

where, Gw denotes a formation range of the recess or the projections on the no-hole region, $S_1$ denotes a distance between one end of the no-hole region to the center of the recess or projections, and $S_2$ denotes a distance from the other end of the no-hole region to the center of the recess or projections. That is, as the damping wire should fit into the groove formed either by the projections or the recess tightly for preventing loose movement of the damping wire in the groove or inadequate fit into the groove owing to too small size of the groove in comparison to the radius of the damping wire, the formation range Gw is required.

Figure 9:
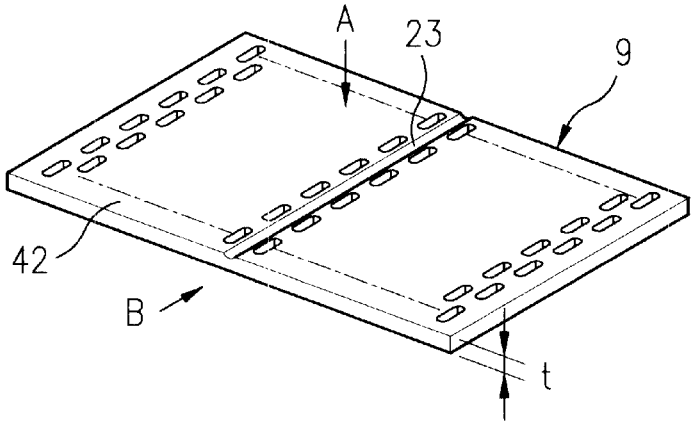
FIG. 9 illustrates a perspective view of a shadow mask in accordance with a fourth preferred embodiment of the present invention.
Figure 10:
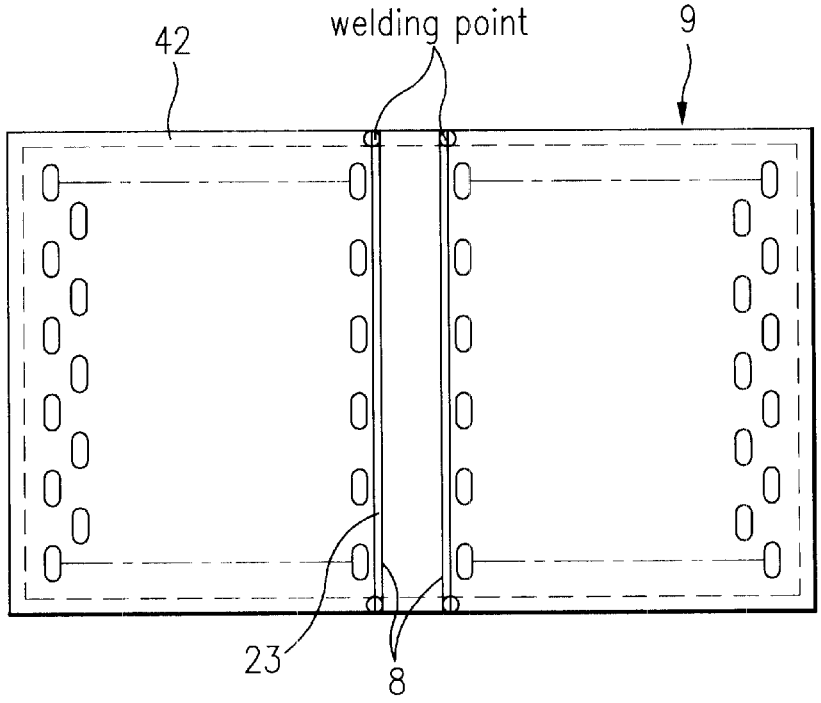
FIG. 10 illustrates a perspective view of a shadow mask of the present invention having a damping wire fastened thereto seen in "A" direction in FIG. 9; and, FIG. 11. illustrates an enlarged view of a welding part of a damping wire seen in "B" direction in FIG. 9.
Figure 11:
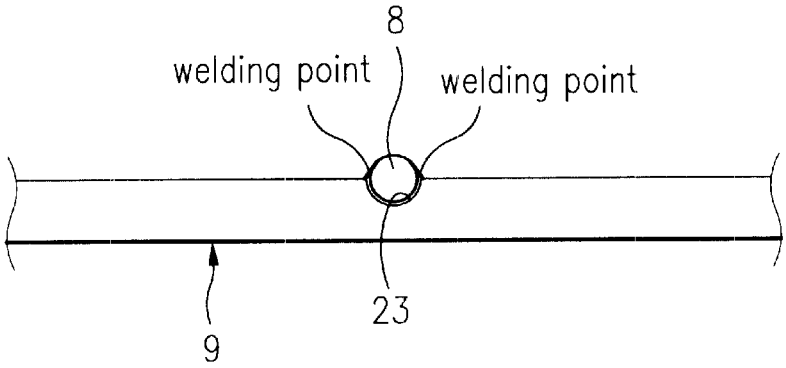

FIG. 9 illustrates a perspective view of a shadow mask in accordance with a fourth preferred embodiment of the present invention, FIG. 10 illustrates a perspective view of a shadow mask of the present invention having a damping wire fastened thereto seen in "A" direction in FIG. 9, and FIG. 11 illustrates an enlarged view of a welding part of a damping wire seen in "B" direction in FIG. 9.

Referring to FIGS. 9~11, the fourth embodiment limiting means includes a groove 23 formed in required region of a no-hole region of the shadow mask 9, and a damping wire 8 in the groove 23 having both ends welded with a skirt 42 of the shadow mask 9. In the fourth embodiment, the damping wire 8 is inserted into the groove 23 formed in a central region of the shadow mask 9 parallel to a short side of the shadow mask 9, and both ends thereof are welded to the skirt 42, edges of the shadow mask 9, directly. In this instance, as the welding is conducted in a state the damping wire 8 is inserted in the groove 23 in the shadow mask 9, as shown in FIG. 11, the damping wire 8 is in surface to surface contact with the groove in the shadow mask 9. This damping wire welding permits to secure relatively great welding area, and prevent movement of the damping wire during the welding, thereby allowing welding of the damping wire 8 at an exact welding position. And, the surface to surface contact between the damping wire 8 and the shadow mask 9 can double an attenuation effect by the damping wire 8 of a shadow mask vibration. From experiments, it is found that, while a duration of the howling caused by a related art shadow mask 3–60 $\mu$m diametered damping wires are fastened each with a 400 gf tension thereto, the duration of howling can be shortened within approx. 7.5 sec., below a half of the related art duration of the howling, even if an 80 $\mu$m diametered damping wire 19 of the present invention is fastened with a 600 gf tension.

As has been explained, the enhancement of a damping effect by doubling fastening force of the damping wire by means of the groove, or projections, and the cut away portions in the shadow mask, and the prevention of the damping wire from getting into a beam pass through hole region permits to provide a better picture quality.

The welding of both ends of the damping wire with the skirt of the shadow mask in the present invention permits to simplify a fabrication process and cut down a production cost since components, such as the brackets and the plates, used for welding the damping wire in the related art can be dispensed with.

The increased welding area of the damping wire in the welding of the damping wire to the shadow mask permits to enhance a vibration attenuation effect, and prevent howling, thereby improve a picture quality.

Since only one damping wire can be required if a thickness of the shadow mask is adjusted appropriately, the fabrication process can be simplified more.

It will be apparent to those skilled in the art that various modifications and variations can be made in the shadow mask in a flat cathode ray tube of the present invention without departing from the spirit or scope of the invention. Thus, it is intended that the present invention cover the modifications and variations of this invention provided they come within the scope of the appended claims and their equivalents.

What is claimed is:

1. A shadow mask in a flat cathode ray tube having a damping wire located across a no-hole region between adjacent lines of beam pass through holes formed on a vertical line in the shadow mask for damping vibration of the shadow mask, comprising:

limiting means for limiting a position of the damping wire provided on the no-hole region of the shadow mask.

2. The shadow mask as claimed in claim 1, wherein the limiting means is a cut away part formed in each side of the shadow mask for limiting movements of the damping wire toward the beam pass through holes by fastening both ends of the damping wire through the cut away parts.

3. The shadow mask as claimed in claim 2, wherein the cut away part has a ⊏ form.

4. The shadow mask as claimed in claim 2, wherein the cut away part has a 'V' form.

5. The shadow mask as claimed in claim 4, wherein the V formed cut away part has an apex angle θ in a range of $20 \leqq \theta \leqq 120°$.

6. The shadow mask as claimed in claim 1, wherein the limiting means are projections for limiting movements of the damping wire toward the beam pass through holes as the damping wire fastened between the beam pass through holes formed on a vertical line in the shadow mask is set between the projections.

7. The shadow mask as claimed in claim 1, wherein the limiting means is a recess for limiting movements of the damping wire toward the beam pass through holes as the damping wire fastened between the beam pass through holes formed on a vertical line in the shadow mask is set in the recess.

8. The shadow mask as claimed in claim 6, wherein the projections are formed in a range of $Gw \leqq S_2 - R + S_1 - R$, where on the no-hole region, Gw denotes a formation range of the projections on the no-hole region, $S_1$ denotes a distance between one end of the no-hole region to a center of the projections, and $S_2$ denotes a distance from the other end of the no-hole region to the center of the projections.

9. The shadow mask as claimed in claim 7, wherein the recess is formed in a range of $Gw \leqq S_2 - R + S_1 - R$, where on the no-hole region, Gw denotes a formation range of the recess on the no-hole region, $S_1$ denotes a distance between one end of the no-hole region to the center of the recess, and $S_2$ denotes a distance from the other end of the no-hole region to the center of the recess.

10. The shadow mask as claimed in claim 6, wherein the limiting means further includes a groove formed in a skirt of the shadow mask for welding both ends of the damping wire located across the shadow mask.

11. The shadow mask as claimed in claim 7, wherein the limiting means further includes a groove formed in a skirt of the shadow mask for welding both ends of the damping wire located across the shadow mask.

12. The shadow mask as claimed in claim 7, wherein the shadow mask has a thickness in a range of 35~80 μm.

13. The shadow mask as claimed in claim 1, wherein the damping wire has a diameter in the range of 60~80 μm.

14. A flat cathode ray tube comprising the shadow mask of claim 1.

15. A shadow mask in a flat cathode ray tube having a damping wire configured to extend across the shadow mask between adjacent lines of beam pass through holes and damp vibration of the shadow mask, comprising:

a limiting device configured to limit a position of the damping wire, wherein the limiting device is provided on the shadow mask between adjacent lines of beam pass through holes.

16. The shadow mask as claimed in claim 15, wherein the limiting device comprises a cut away part formed in side edges of the shadow mask, wherein movement of the damping wire toward the beam pass through holes is limited by fastening both ends of the damping wire through the cut away parts.

17. The shadow mask as claimed in claim 15, wherein the limiting device comprises projections wherein the damping wire is set between the projections.

18. The shadow mask as claimed in claim 15, wherein the limiting device comprises a recess, wherein the damping wire is set in the recess.

19. A flat cathode ray tube comprising the shadow mask of claim 15.

* * * * *